United States Patent [19]

Albright et al.

[11] 4,043,253

[45] Aug. 23, 1977

[54] BOOM CYLINDER STOP FOR THE LIFT CYLINDERS OF A SKID STEER VEHICLE

[75] Inventors: Larry E. Albright; Dan A. Frederick, both of Gwinner, N. Dak.

[73] Assignee: Clark Equipment Company, Buchanan, Mich.

[21] Appl. No.: 701,939

[22] Filed: July 2, 1976

[51] Int. Cl.[2] ..... F15B 15/26

[52] U.S. Cl. ..... 92/25; 92/27; 188/67; 212/59 A; 214/776

[58] Field of Search ..... 92/25, 17, 14, 27, 23, 92/28, 19; 188/67; 214/774–776, 131 R, 141; 212/59 A, 39; 298/17 B; 187/8.47, 8.49; 172/466, 481

[56] References Cited

U.S. PATENT DOCUMENTS

| | | | |
|---|---|---|---|
| 1,512,837 | 10/1924 | Evenden | 92/19 |
| 2,303,320 | 12/1942 | Benjamin et al. | 92/14 |
| 2,433,023 | 12/1947 | Bukolt | 188/67 |
| 2,512,150 | 6/1950 | Geren | 92/23 |
| 2,706,009 | 4/1955 | Schramm | 92/19 |
| 2,896,583 | 7/1959 | Stixrood | 92/19 |
| 3,135,555 | 6/1964 | Caskey | 92/23 |
| 3,502,228 | 3/1970 | Tamborino | 212/39 R |
| 3,799,036 | 3/1974 | Slaughter | 92/17 |
| 3,982,648 | 9/1976 | Luedtke et al. | 92/23 |

*Primary Examiner*—Lawrence J. Oresky
*Attorney, Agent, or Firm*—Harry G. Thibault

[57] ABSTRACT

A boom stop having a elongated tubular body portion is mounted on the rod end of one of the hydraulic lift cylinders of a skid steer loader. When the boom of the skid steer loader is lifted, the boom stop is carried outwardly with the rod end of the cylinder, the opposite end of the boom stop dropping into a plane adjacent the rod end of the cylinder when the hydraulic cylinder is almost fully extended. Thus the boom stop is interposed between the outer end of the cylinder body and the rod end of the cylinder to retain such lift cylinder in an extended position under loading conditions. A projection provided at a lower end of the boom stop carries a toggle mechanism mounted on a pivotal connection, the mechanism including a ramp like projection which rotates downwardly when the cylinder is extended further outwardly to disengage the stop from the cylinder body, the ramp engaging both the cylinder body and the body portion of the stop to slide the body portion of the stop onto the cylinder body when the cylinder is pulled back to a fully retracted position.

4 Claims, 3 Drawing Figures

BOOM CYLINDER STOP FOR THE LIFT CYLINDERS OF A SKID STEER VEHICLE

BACKGROUND OF THE INVENTION

1. Field of the Invention

This invention pertains to stop means associated with a hydraulic cylinder and more particularly a retractable stop member associated with the lift cylinder of a skid steer vehicle.

2. Description of the Prior Art

In a skid steer loader, the installation of a boom stop on a lift cylinder of the vehicle is a two-man operation. The vehicle operator must remain in his machine to raise a load overhead and adjust the lift cylinders under the load, while a second man inserts a stop between the extreme ends of the rod end of the cylinder to retain the cylinder in the extended position. Of course, the driver also must be in his vehicle when the boom stop is to be removed to control the loaded bucket when it is unrestrained by the boom stop.

Thus it would be desirable that a boom stop could be provided which could be mounted on the lift cylinder of the vehicle by the driver, be readily engaged by the driver without the aid of another and be readily and selectively disengaged in the extended position of the cylinder when the cylinder is to be retracted so that neither stop nor cylinder are damaged when there is an attempt to withdraw the cylinder to a fully retracted position with the stop in place.

Finally, a desirable characteristic of an adequate stop is relatively inexpensive cost.

SUMMARY OF THE INVENTION

The present invention provides a relatively simple and inexpensive boom stop for the lift cylinders of a skid steer vehicle which can be installed solely by the vehicle operator. Thus, the boom stop can be readily engaged and disengaged during operation of the hydraulic cylinder without outside assistance to the operator.

In accordance with the present invention the boom stop comprises a tubular body portion mountable on the cylinder body of a hydraulic cylinder of a vehicle, a first end portion of the stop being carried on the rod end of the hydraulic cylinder and a second end portion of the tubular body of the stop including an outwardly extending projection, said projection having disengaging means pivotally mounted thereon.

When the hydraulic cylinder is extended the stop is carried outwardly along with the rod end of the cylinder to a substantially extended position wherein the tubular body of the stop drops from an abutting relationship with the cylinder body to an abutting relationship in the plane of the rod end of the cylinder, with the rear end of the stop engaging the outer end of the cylinder body in an interference relationship between opposite ends of the cylinder rod to maintain the hydraulic cylinder in the extended position.

To release the stop, the hydraulic cylinder is extended slightly forward of the interference position causing a toggle mechanism mounted on the projection provided at the rear end of the stop to rotate about its pivot point, dropping a ramp-like projection provided on the toggle mechanism into interfering relationship between the outer edge of the cylinder body and the rear edge portion of the tubular body of the stop. Thus, when the hydraulic cylinder is retracted the tubular body of the stop is disengaged by the toggle mechanism and is carried by the ramp-like projection on the mechanism to the plane of the cylinder body, and then along the cylinder body to the fully retracted position of the cylinder.

A better understanding of the present invention may be had by a complete reading of the specification as well as a consideration of the accompanying drawings.

DETAILED DESCRIPTION OF THE PREFERRED EMBODIMENT

Figure 1:
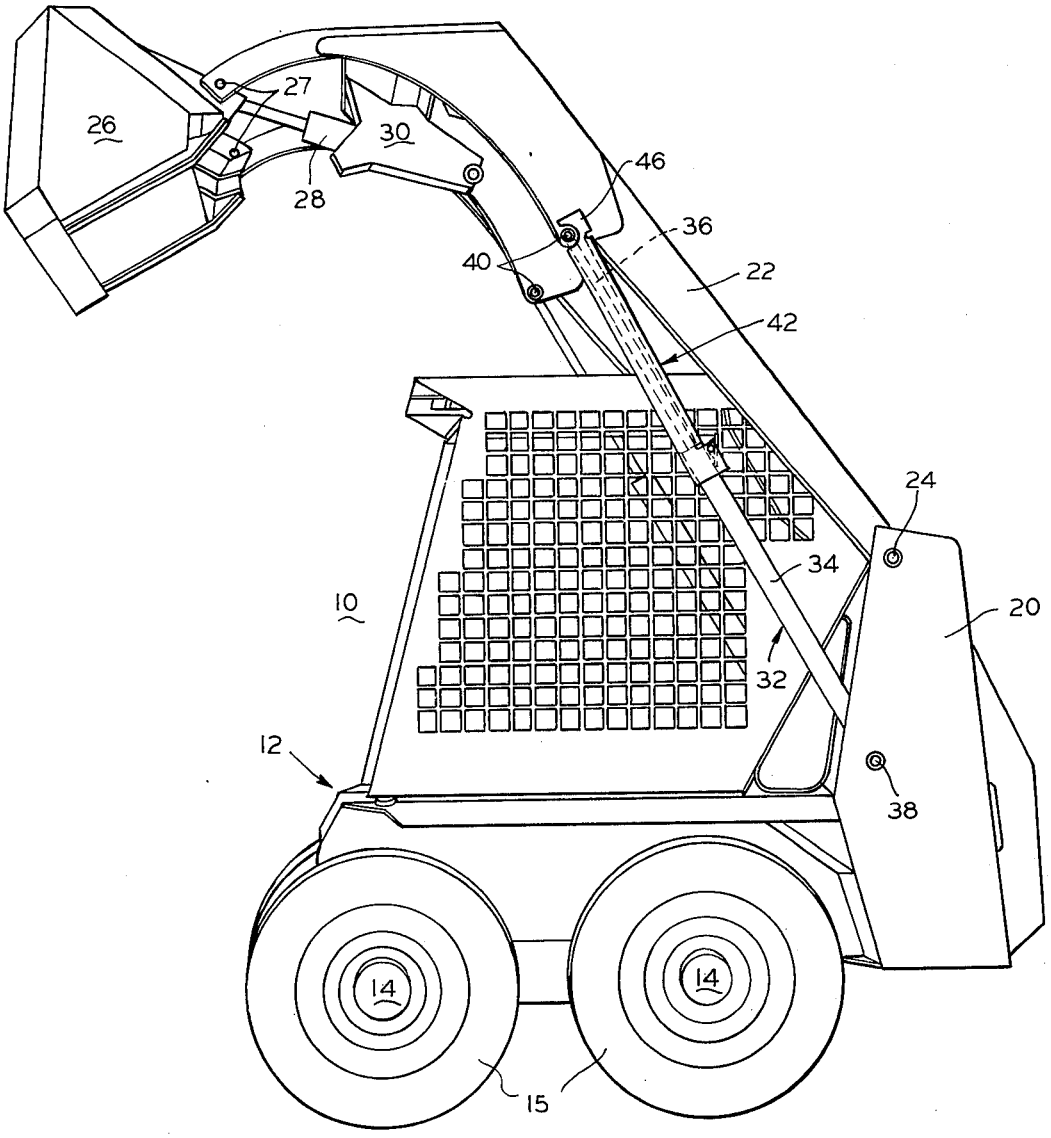
FIG. 1 is a side perspective view of a skid steer loader incorporating the boom stop of the present invention, with the lift cylinders of the vehicle in the extended position, and the stop mounted on the lift cylinder in the foreground, in operative relationship therewith.

The skid steer vehicle 10 shown in FIG. 1 and incorporating the boom stop of the present invention is disclosed in U.S. Patent application Ser. No. 654,256 entitled "Loader Main Frame For a Skid Steer Vehicle", filed Feb. 2, 1976, and assigned to the assignee of the present invention, and reference may be had thereto for a more complete description of the skid steer vehicle shown here.

The vehicle 10 comprises a channel-shaped skid steer body 12 having stub axles 14 secured thereto. Mounted on the stub axles 14 are wheels 15. The front and rear wheels of each side comprise a drive unit (not shown) including a hydrostatic drive motor mounted on the body portion of the vehicle, drive sprockets provided on the inner ends of the front and rear stub axles 14 of the vehicle 10, and an endless chain interwoven between the drive sprockets and the operating means of each drive unit of the vehicle.

Load carrying members of the vehicle 10 comprise uprights 20 mounted at the rear end of the frame 12 of vehicle 10. Boom arms 22 are pivotally mounted at the rear end thereof to the uprights 20 by means of a pivotal connection 24. The uprights 22 curve downwardly at front end portions thereof to extend over the front wheels 15 of vehicle 10. Carried at the lower end of the boom arms 22 is a bucket 26 mounted thereon by pivotal connectors 27. A bucket tilt cylinder 28 is mounted between the boom arms 22 on a mounting bracket 30 for operating a load-unload cycle of the bucket 26.

A boom lift cylinder 32 is provided on each side of the vehicle 10 to raise the boom arms 22. The boom lift cylinder 32 comprises a cylinder body 34 and an extensible rod 36. A pivotal connection 38 is provided at the cylinder end of the cylinder 32 between the upright 20 and the cylinder 32 and a pivotal connection 40 is provided at the rod end of the rod 38 of the cylinder 32 between the rod end of the cylinder and the forward end of the boom arm 22.

Interposed between the forward end of the cylinder portion 34 of the hydraulic cylinder 32 and the rod end of the rod portion 36 of the hydraulic cylinder 32 is a boom stop 42 retaining the cylinder 32 in an extended position.

The boom stop 42 comprises a channel-shaped member 43 having a base portion 44 and opposite side portions 45. At one end of the stop 42 the side portions 45 comprise a C-shaped section 46 which extends forward of the body portion 43. At the opposite end of the boom stop 42, the side portions 45 include extensions 47 which project rearwardly and outwardly of the body portion 43. Carried on extensions 47 of the side portions 45 is a pivotal connection 48 having a pivot pin 50 mounted therein. Carried on the pivot pin 50 is a toggle mechanism 52 comprisng a base portion 54 through which the pivot pin 50 passes and a ramp portion 56. The toggle mechanism 52 is free to rotate about the the pin 50, with the ramp 56 in interfering relationship with the base portion 44 of the boom stop 42 when the toggle mechanism 52 is rotated to position C shown in FIG. 3.

OPERATION OF THE PREFERRED EMBODIMENT

Figure 2:
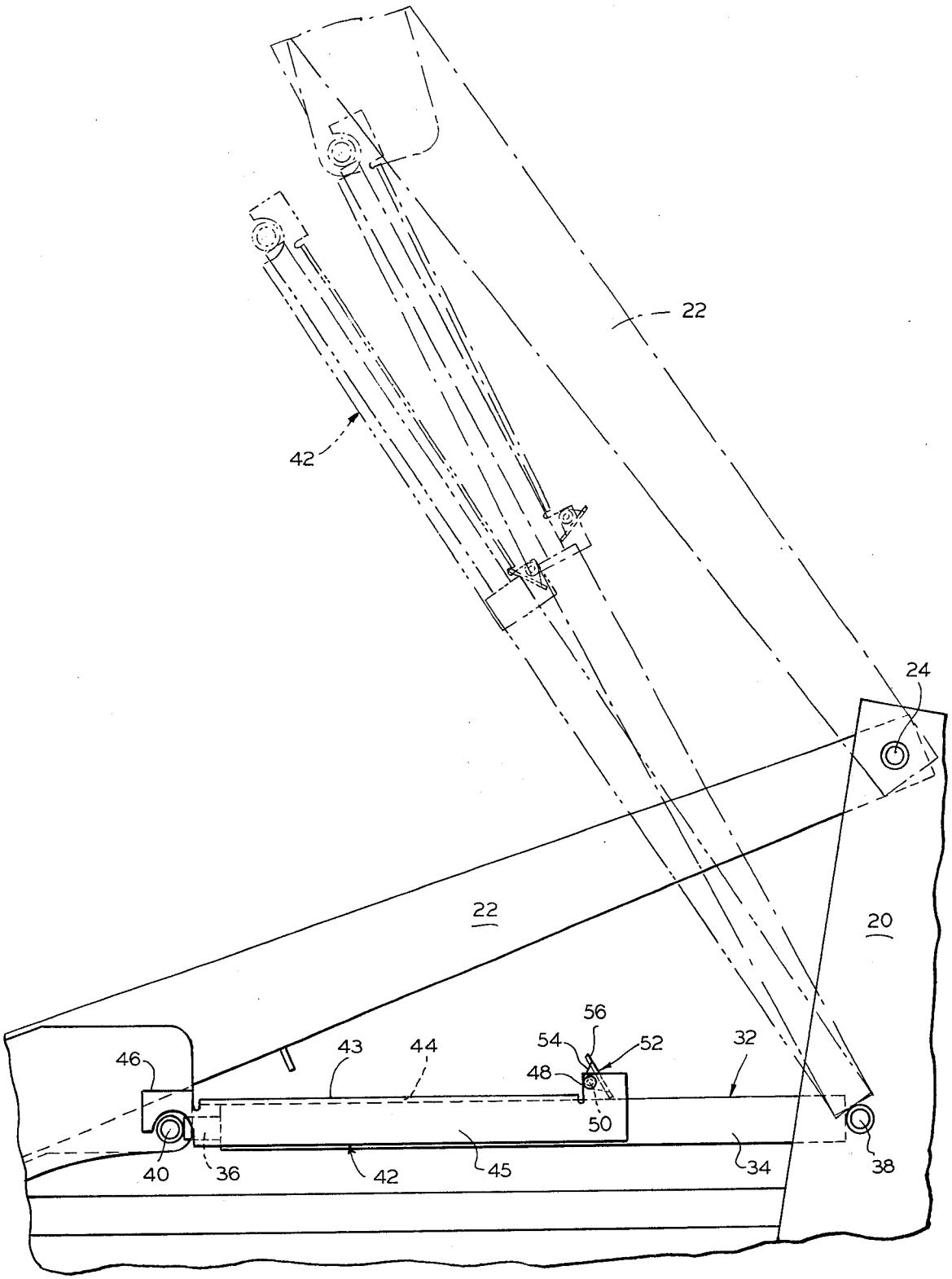
FIG. 2 is a schematic drawing showing a portion of the boom assembly of the vehicle shown in FIG. 1, showing the return cycle of the hydraulic cylinder with the boom stop in place, from the extended position to the fully retracted position, with intermediate extensions of the assembly being shown in phantom in the drawing.

The boom stop 42 overlies the cylinder body 34 of the hydraulic cylinder 32 when the cylinder is in the retracted position shown in solid lines in FIG. 2. In the retracted position the C-shaped portion 46 at the forward end of the stop 42 engages the pivotal connection 40 on the front end of the boom arm 22. The body portion 43 of the stop 42 overlies the cylinder body 34 with the toggle mechanism 52 free to rotate about the pivotal connection 48 carried on the extension 47 at the opposite end of the stop 42.

As the boom is raised to the elevated position shown in FIG. 1 by the hydraulic lift cylinders 32, the stop 42 overlying the cylinder body 34 is free to move forward relative to the cylinder body 34 as the rod end 36 of the cylinder 32 is pushed outwardly. When the rod end 36 of the cylinder 32 exceeds the length of the base portion 44 of the stop 42 the body portion 43 of the stop 42 drops from the cylindrical body 34 to the rod end 36 to be in interfering relation between the forward end of the cylinder body 34 and the pivotal connection 40 at the rod end 36 of the cylinder 32. The ramp 56 of the toggle mechanism 52 carried on the projection 47 at the lower end of the stop 42 is biased to position A shown in FIG. 3 due to the force of gravity when the stop member 42 is in an interference relation with the hydraulic cylinder 32. Thus in the position shown in FIG. 1 the boom stop 42 effectively retains the lift cylinder 32 in the extended position.

Figure 3:
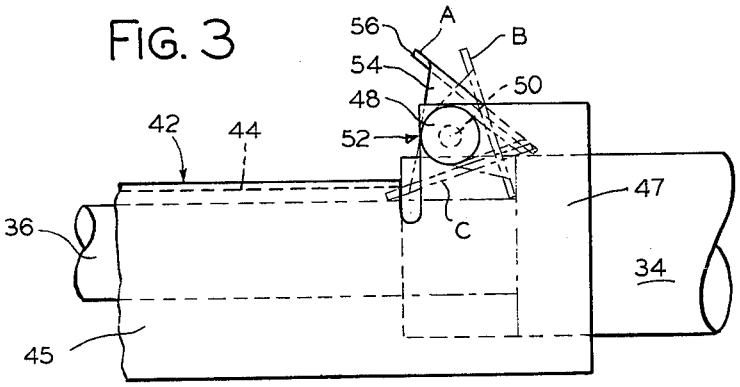
FIG. 3 is an enlarged detail view of the rear portion of the boom stop, including the toggle mechanism mounted thereon, with various positions of the toggle mechanism being shown in phantom.

To disengage the boom stop member 42 the rod end 36 of the cylinder 32 is extended forwardly to carry the end of the base portion 33 beyond the point of interference with the cylinder body 34 and to drop the ramp 56 of the toggle mechanism 52 on to the rod end 36 of the cylinder to position B in FIG. 3. Reverse movement of the cylinder 32 to the retracted position rotates the ramp 56 to position C into engagement with the body portion 43 of the stop 42. At position C the ramp 54 is in interfering relationship with the lower end of the base 44 of the body portion 43 of the stop 42. Further retraction of the cylinder 32 draws the rod end 36 into the cylinder body 34 to raise the body portion 43 of the stop 42 along the ramp 56 and onto the cylinder body 34 of the cylinder 32. With the body portion 43 of the stop 42 overlying the cylinder body 34 the hydraulic cylinder can be returned to the fully retracted position.

In one embodiment shown the toggle mechanism 52 is biased toward the operating position by the effects of gravity. In other uses it may be desirable to bias such a mechanism toward the interference fit wherein the ramp engages the lower part of the base by means of a spring or other suitable biasing means.

We have thus described a particular embodiment of our invention which provides an inexpensive retractable boom stop for use with a hydraulic cylinder of a skid steer vechicle. Obviously, the stop may be used in other like applications and persons skilled in the art will be able to modify certain of the structure that has been illustrated and to substitute equivalent elements for those which have been disclosed. Therefore, it is intended that all such modifications and substitutions be covered and embraced in the scope of the appended claims.

We claim:

1. For an extensible hydraulic cylinder, a stop member for retaining the cylinder in an extended position comprising a tubular body portion receivable on the cylinder body of the hydraulic cylinder, a first end portion of the stop having means engageable with the rod end of the hydraulic cylinder and a second end portion of the stop comprising means engageable with the forward end of the cylinder body, the second end portion including an outwardly extending projection having means for disengaging the stop pivotally mounted thereon, said means operable to release the stop from an interference relationship between the rod end of the cylinder and the cylinder body when the cylinder is retracted.

2. A stop member as claimed in claim 1 wherein the tubular body portion comprises a channel-shaped member having a base portion and side portions extending therefrom, said side portions extending forwardly and rearwardly of the base portion of the stop, the forward extension of the side portions comprising a C-shaped portion engageable with the rod end of the hydraulic cylinder, the rear extension of the side portions of the stop including respective outward projections of the stop having a toggle mechanism pivotally mounted thereon for disengaging the body portion of the stop from its interference relationship with the cylinder body.

3. A stop for a hydraulic cylinder as claimed in claim 2 wherein the means for disengaging the stop comprise a toggle mechanism mounted on the rear projections of the stop, said toggle mechanism including a base portion pivotally mounted on the rear projections and a ramp mounted on the base portion of the mechanism, said ramp rotatable into interfering relationship with the base portion of the stop and the forward end of the cylinder body in such a manner that retraction of the hydraulic cylinder will carry the ramp associated with the stop up a forward face of the cylinder body to slide the body portion of the stop on to the cylinder body when the cylinder is moved to a retracted position.

4. An elongated stop member for use with an extensible hydraulic cylinder, the stop member comprising an elongated body portion having a first end portion engageable on a rod end of the hydraulic cylinder, an opposite end portion having an outwardly directed portion and including means engageable with a cylinder body of the hydraulic cylinder, the body portion of the stop member being mounted on the cylinder portion of the hydraulic cylinder when the cylinder is in the retracted position, the stop member being carried outwardly with the rod end of the hydraulic cylinder when the cylinder is extended, with said opposite end portion dropping into engagement with an outer end of the cylinder body of the hydraulic cylinder when the rod end of the cylinder is extended, with the boom stop interposed between the upper end of the cylinder body and the rod end of the cylinder, and a toggle mechanism carried on a pivotal connection provided at said opposite end of the boom stop, the toggle mechanism comprising a base portion and a ramp portion, whereby extension of the hydraulic cylinder forwardly beyond the stop position to bring the body portion of the stop out of engagement with the outer end of the cylinder portion of the cylinder permits rotation of the toggle mechanism about the pivotal connection on the stop to interpose the ramp between the cylinder body of the hydraulic cylinder and the body portion of the boom stop, the ramp carrying the body portion of the boom stop on to the cylinder body of the hyraulic cylinder when the hydraulic cylinder is closed to the fully retracted position.

* * * * *